US008668103B2

(12) United States Patent
Zeiss

(10) Patent No.: US 8,668,103 B2
(45) Date of Patent: Mar. 11, 2014

(54) PACKAGE WITH A SLEEVE HAVING A SELF-INITIALIZING LOCKING TAB

(75) Inventor: Peter Zeiss, Villa Park, IL (US)

(73) Assignee: Transparent Container Co., Inc., Addison, IL (US)

( * ) Notice: Subject to any disclaimer, the term of this patent is extended or adjusted under 35 U.S.C. 154(b) by 0 days.

(21) Appl. No.: 13/285,705

(22) Filed: Oct. 31, 2011

(65) Prior Publication Data

US 2013/0105480 A1 May 2, 2013

(51) Int. Cl.
*B65D 5/36* (2006.01)
*B65D 5/18* (2006.01)

(52) U.S. Cl.
CPC ..... *B65D 5/3614* (2013.01); *B65D 5/36* (2013.01)
USPC ..... 220/7; 220/270; 229/122

(58) Field of Classification Search
CPC ..... B65D 17/163; B65D 17/161; B65D 11/1833; B65D 5/16; B65D 5/3614; B65D 5/3607; B65D 5/36
USPC ..... 220/7, 6, 23.89, 23.87, 23.83, 270, 266, 220/265, 359.2, 359.1; 229/122, 103.2, 229/125.125; 206/531, 1.5, 231
IPC ..... B65D 5/18
See application file for complete search history.

(56) References Cited

U.S. PATENT DOCUMENTS

| | | | | |
|---|---|---|---|---|
| 1,253,489 | A * | 1/1918 | Houghland | 229/125.125 |
| 1,888,818 | A * | 11/1932 | Daller | 229/204 |
| 2,581,944 | A * | 1/1952 | Donnell | 229/125.125 |
| 2,595,202 | A * | 4/1952 | Pardee | 229/120.15 |
| 3,071,306 | A * | 1/1963 | Trethewey | 229/122 |
| 3,302,844 | A * | 2/1967 | Warren | 229/120.18 |
| 3,521,810 | A | 7/1970 | Boyer | |
| 4,308,986 | A * | 1/1982 | Parrilli | 206/470 |
| 4,488,644 | A * | 12/1984 | Wynalda | 206/387.14 |
| 4,497,432 | A | 2/1985 | Milia | |
| 6,168,073 | B1 | 1/2001 | Towle | |
| 7,389,875 | B2 | 6/2008 | Sandberg et al. | |
| 7,882,953 | B2 | 2/2011 | Heller et al. | |
| 2006/0131205 | A1 * | 6/2006 | Sandberg et al. | 206/538 |
| 2008/0142397 | A1 * | 6/2008 | Heller et al. | 206/499 |

* cited by examiner

*Primary Examiner* — Robert J Hicks
(74) *Attorney, Agent, or Firm* — Greenberg Traurig, LLP

(57) ABSTRACT

A self-locking package comprising a sleeve having a self-initializing locking tab and a slidable insert. The sleeve comprises a plurality of panels forming a substantially quadrilateral cross section. The locking tab extends between a top panel and a bottom panel and is offset from corners of the quadrilateral. An insert for retaining an item is at least partially insertable within an opening of the sleeve and includes a notch formed in at least one portion of the perimeter of the insert, such that when the insert is properly inserted into the sleeve, the locking tab seats within the notch to substantially prevent relative movement between the insert and the sleeve.

25 Claims, 6 Drawing Sheets

PACKAGE WITH A SLEEVE HAVING A SELF-INITIALIZING LOCKING TAB

FIELD OF THE DISCLOSURE

The present disclosure relates generally to a self-locking merchandise package and more particularly to a package with a sleeve having a self-initializing locking tab.

BACKGROUND OF RELATED ART

Packaging containers including foldable tabs for retaining a slidable insert are generally well known. For example, U.S. Pat. No. 6,168,073, describes a storage container having an integrally formed inner and outer member. The inner member is slidably movable between a retracted position within the outer member and an extended position extending from the front opening of the outer member. The outer surface of the outer member includes accessible and moveable securement tabs at the end near the opening to temporarily secure the inner member within the outer member as desired. The securement tabs may be re-actuated as many times as desired.

Similarly, U.S. Pat. No. 3,521,810 describes an adjustable length container having an outer sleeve slidable over an inner sleeve. The inner sleeve includes a plurality of slits along the length of the container and the outer sleeve includes a plurality of slits that are capable of being forced inward by a tab formed on the outer sleeve to lock the sleeves together and to prevent relative movement of the sleeve. The lock may be repeatably removed and reapplied as desired to adjust the length of the container.

U.S. Pat. No. 7,882,953 describes another example of an externally accessible locking tab disposed on the end portion of a sleeve to temporarily maintain a slidable insert therebetween. The package includes a sleeve having foldable tabs at the top and bottom that lock into indents at the top and bottom of the insert. Finally, U.S. Pat. No. 7,389,875 describes a package having an insert slidable into a sleeve. The sleeve includes a locking member having a tortuous path including an arch-shaped portion extending into the rectangular cross section to releasably retain the insert.

DETAILED DESCRIPTION

The following description of example methods and apparatus is not intended to limit the scope of the description to the precise forms detailed herein. Instead the following description is intended to be illustrative so that others may follow its teachings.

There remains a need for improvement over the known locking sleeves. For example, in the present disclosure, the example package generally includes an outer folded sleeve having a self-initializing locking tab and an inner formed tray. The tray, when inserted into the sleeve is used to contain product and prevents easy removal. When the two pieces are assembled, the interlock between the sleeve and the tray is difficult to detect and the pieces difficult to separate. The outer sleeve is capable of being folded essentially flat and has a locking tab that deploys automatically when erected from the flat position into the final profile shape. The tray, meanwhile, includes a reverse shaped notch that the erected locking tab on the sleeve keys into.

Because of at least the above-described features, the package described herein provides an advantage over the known locking sleeves. For instance, in the described package, no additional equipment or operations are necessary to facilitate the internal locking feature. Insertion of the tray into the sleeve is easy, while removal of the tray is difficult without damaging the outer sleeve. The item(s) in the container tray may be completely secured within the sleeve preventing removal of the item, and the packaging around the outer sleeve may be used to obscure the locking mechanism, thus making it difficult to detect and overcome.

Figure 1:
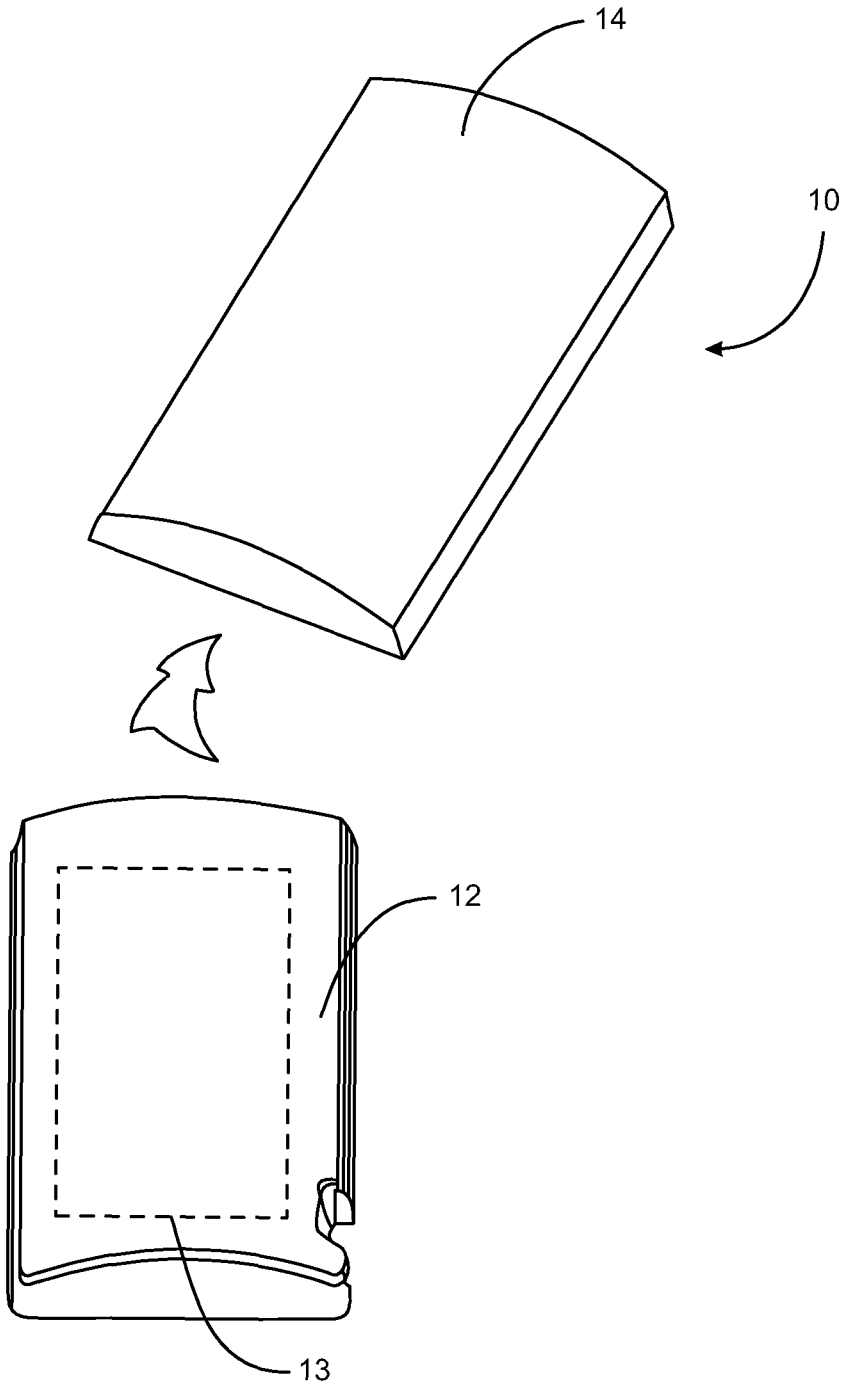
FIG. 1 is a top perspective view of an example package in accordance with one example of the present disclosure.

Referring to FIG. 1, an example package assembly 10 is generally shown. The example package 10 includes an insert, such as, a product tray 12 and a locking sleeve 14. As illustrated, the example sleeve 14 is adapted to receive and lockingly retain the tray 12 as will be described in detail below. The tray 12 may be any packaging tray suitably sized to contain a merchandise item therein. Similarly, the sleeve 14 may be suitably sized to at least partially enclose the tray 12 and/or any item contained by the tray 12 within the sleeve 14. Both the tray 12 and the sleeve 14 may be formed of any suitable paper, metal, and/or plastic material including, but not limited to, polyvinyl chloride (PVC), polyethylene terephthalate (PET), polyethylene teraphthalate glycol (PETG), polylactic acid (PLA), polypropylene (PP), oriented polystyrene (OPS), or the like. Either of the tray 12 or the sleeve 14 may be constructed of a resilient and/or otherwise flexible material, or may alternatively comprise a substantially rigid material. Additionally, in at least one example, the tray 12 is thermoformed and/or otherwise molded to provide a custom cavity 13 (in this example, a rectangular shaped depression) to retain the merchandise item therein. The example cavity 13 includes end walls 15 that prevent access to the cavity 12 when the tray 12 is retained by the sleeve 14.

As will be detailed below, once assembled, the locking sleeve 14 creates an interlock with the tray 12 such that the package 10 is difficult to separate. In this example, the interlock is located offset from the open end of the sleeve 14 and the closed end 15 of the tray 12 such that physical interaction with the interlock may be difficult when the tray 12 is retained in the sleeve 14. Additionally, in at least one example, the locking mechanism may be hidden from external view (through printing, graphics, constructions, etc) thus making the interlock mechanism difficult to detect and/or defeat.

Figure 2A:
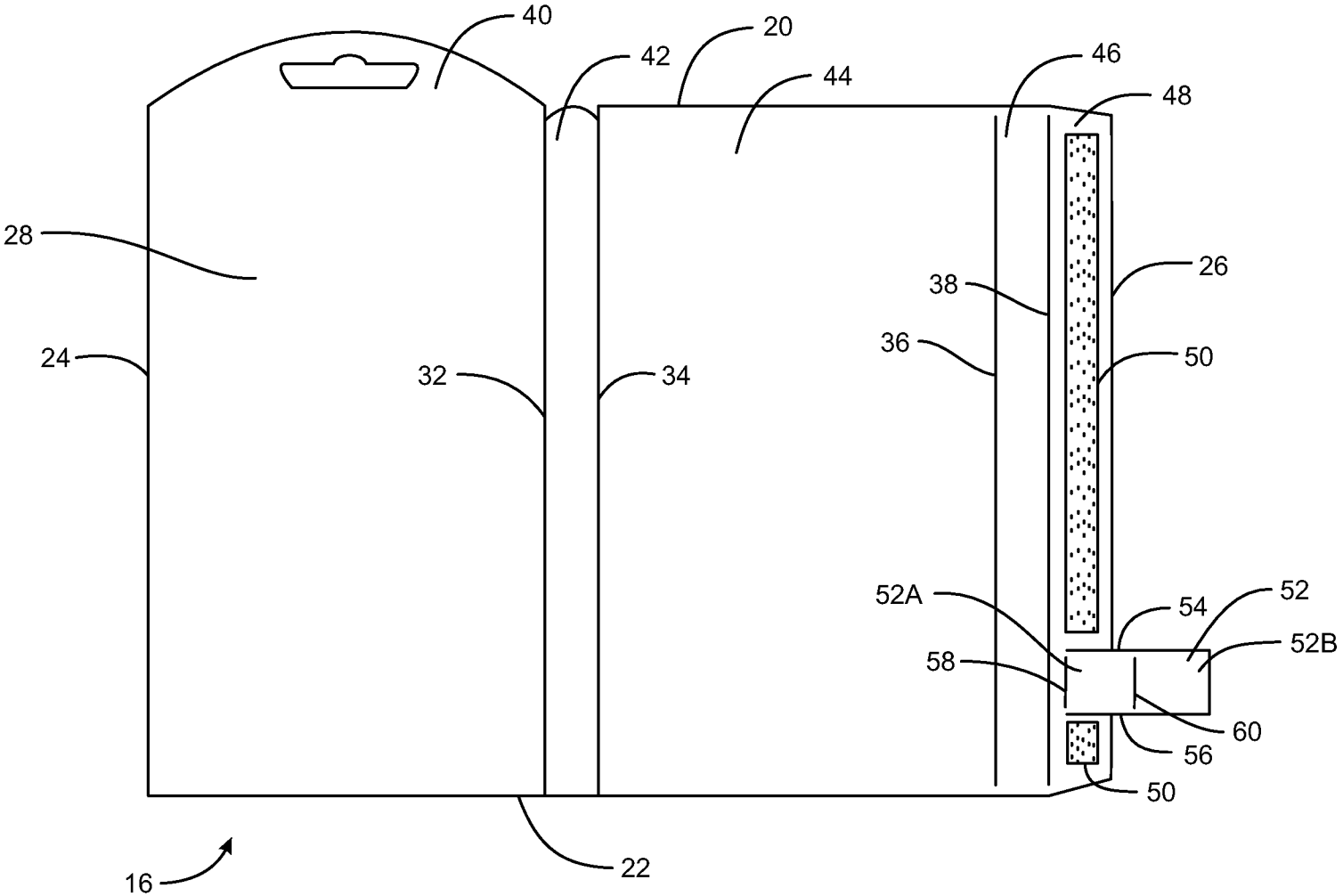
FIGS. 2A and 2B each illustrate a plan view of a face of an example blank which may be utilized to construct an outer sleeve of the example package of FIG. 1
Figure 2B:
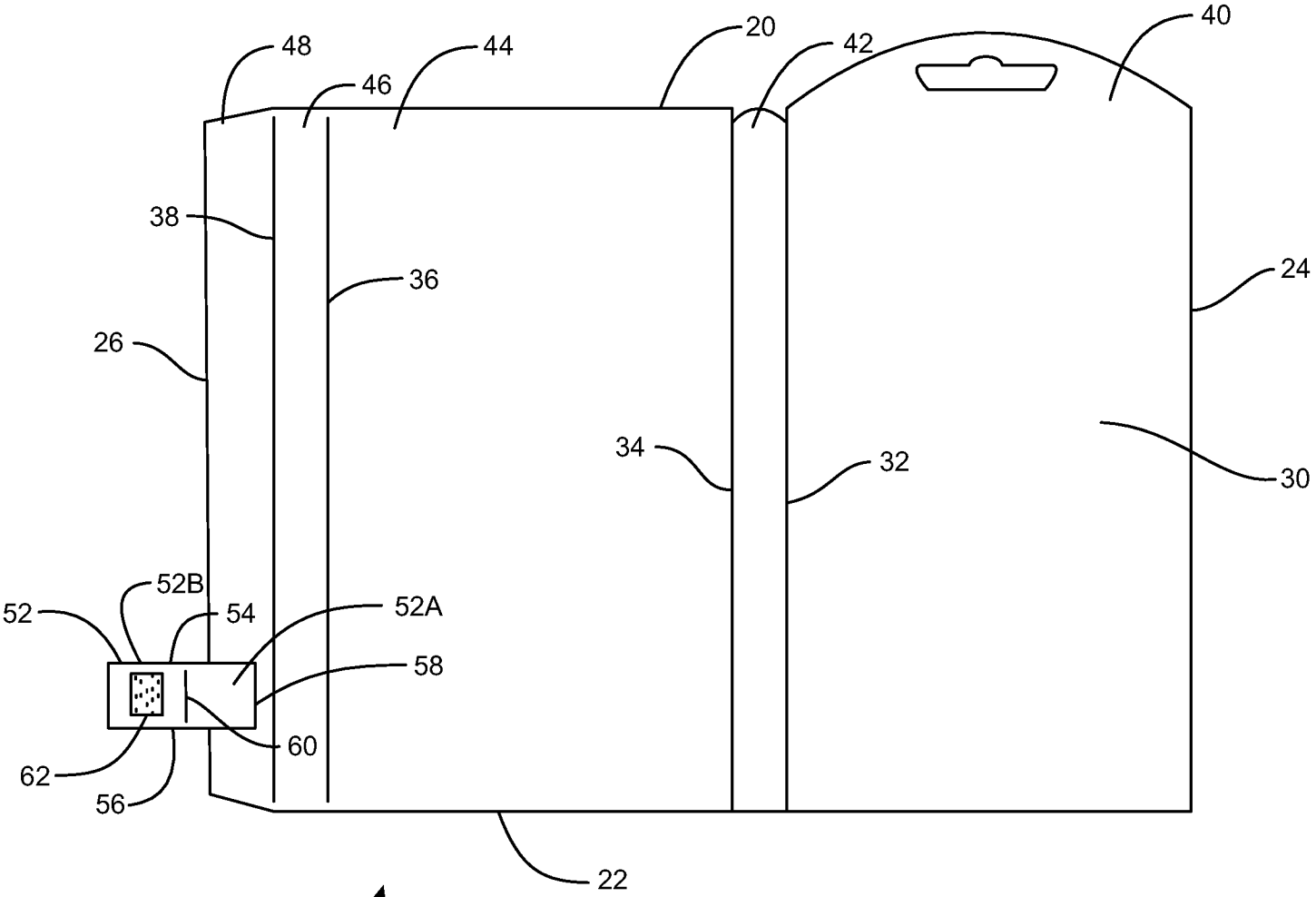

As illustrated in FIGS. 2A, 2B, the example sleeve 14 is shown prior to assembly as a sleeve blank 16. The example sleeve blank 16 includes a generally quadrate sheet of transparent plastic material having generally parallel top an bottom edges 20, 22, and generally parallel first and second side edges 24, 26, respectively. The blank 16 defines a first face 28 (FIG. 2A) and a second face 30 (FIG. 2B). In this example, the first face 28 will ultimately become the outer face of the assembled sleeve 14, while the second face 30 will ultimately become the inner face of the sleeve 14. It will be understood that the blank 16 may be at least partially formed of a material that is transparent, translucent, opaque, clear, or any combination thereof. Additionally, the blank 16 may include graphics, printing, texturing, and/or any other surface ornamentation and/or design on either face 28, 30 as desired.

In this example, the blank 16, when assembled, forms the sleeve 14 with a generally rectangular cross section with open ends as will be described. Accordingly, in this example the sleeve 16 includes first, second, third, and forth fold lines 32, 34, 36, 38, respectively provided generally parallel to the side edges 24, 26 for dividing the blank 16 into five panels 40, 42, 44, 46, and 48. The fold lines 32, 34, 36, 38 may be any fold line, and/or any suitable line of weakness, such as for example, a perforated line. Additionally, in this example, at least the fold lines 32, 34 are perforated sufficiently so that the may be torn and/or otherwise broken along the fold line 32, 34 to open the package 10 once fully assembled. It will be appreciated that in other examples, additional or alternative perforations, apertures, and/or other opening means (tabs, adhesives, etc.) may be provided at the same or different locations as desired.

In the example blank 16, the first panel 40 and the third panel 44 are substantially equal width, and the second panel 42 and the fourth panel 46 are similarly substantially equal width. Together the first, second, third and fourth panels 40, 42, 44, and 46 form the sleeve 14 when folded in the same direction along the fold lines 32, 34, 36, 38. The example panel 48 is an adhesive panel suitable for accepting an adhesive 50 on the first face 28. In this example, the panel 48 is illustrated as depending from the fourth panel 46, but may depend from the first panel 40 in other examples. Additionally, while the adhesive 50 is illustrated as being applied to the first face 28 of the panel 48, it will be understood that the adhesive may be applied to any surface or combination of surfaces in any pattern as desired. In this example, the adhesive 50 is a substantially permanent adhesive, disposed in a linear pattern, although any suitable adhesive may be utilized in any suitable pattern.

Depending at least partially from the panel 48 is a locking tab 52. The example locking tab 52 is separated from the panel 48 along the top edge 54 and the bottom edge 56 and it connected to the panel 48 at a fold line 58. The fold line 58, in this example, is offset from the fold line 38 towards the side edge 26. The locking tab 52 also includes a second fold line 60. In this example, the distance between the fold line 58 and the second fold line 60 of the locking tab 52 is at least the same or greater width as the width of the panel 46. The fold lines divide the locking tab into a locking portion 52A and a adhesive portion 52B. The second face 30 of the adhesive portion 52B of the locking tab 52 may be provided with an adhesive 62. Similar to the adhesive 50, the adhesive 62 is a substantially permanent adhesive, disposed in a spot pattern, and may be any suitable adhesive in any suitable pattern, disposed on any suitable surface, such as for example, the surface 30 of the panel 44.

Figure 3:
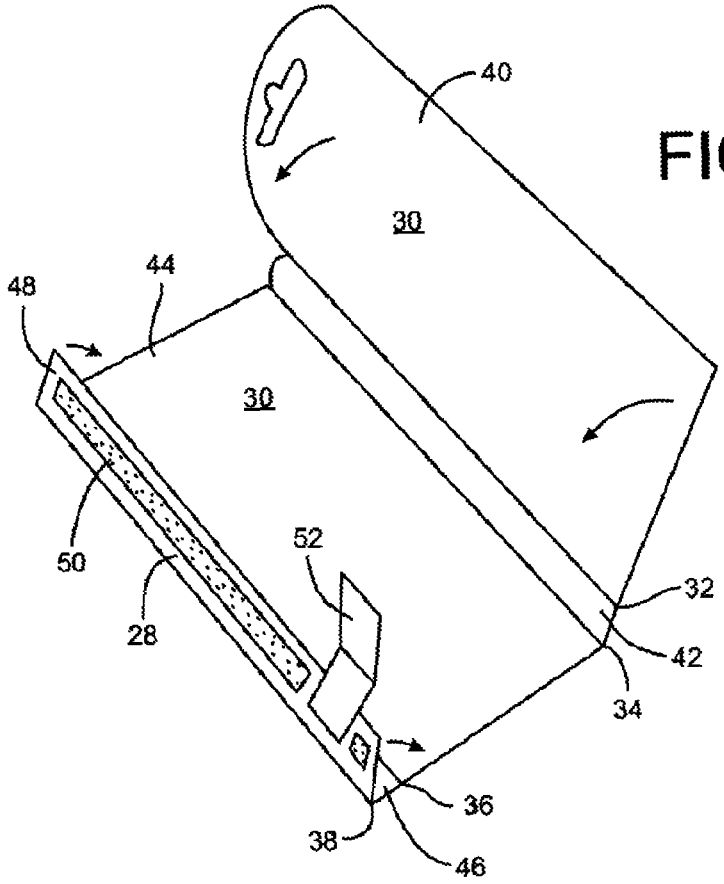
FIG. 3 is a perspective view showing on example method of assembling the example blank of FIGS. 2A and 2B.

Referring to FIG. 3, to assemble the sleeve 14, the example sleeve blank 16 is first folded about the fold line 38 such that the adhesive 62 (hidden from view in FIG. 3) on the locking tab 52 contacts and adheres to the second face 30 of the panel 44. The blank 16 is then folded about the fold line 34 until the second face 30 of the panel 40 contacts and adheres to the adhesive 50 on the first face 28 of the panel 48. Thus, as is evident, the example sleeve 14 forms a hollow container having two open ends to allow passage of the example tray 12 therein. It will be appreciated that the method, steps, and/or order of assembling the sleeve 14 may vary without departing from the scope of the present disclosure.

Figure 4:
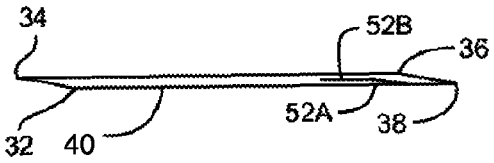
FIG. 4 is a bottom elevational view of the assembled sleeve of FIG. 3 prior to opening.
Figure 5:
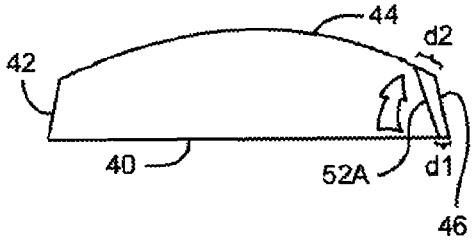
FIG. 5 is a bottom elevational view of the assembled sleeve of FIG. 3 after opening and showing deployment of the self-initializing locking tab.

Turning to FIG. 4, the example assembled sleeve 14 is illustrated in a bottom elevational view, with the sleeve 14 rotated from FIG. 3 such that the panel 40 is now at the bottom. In the illustrated example, it can be seen that the sleeve 14 folds essentially flat, which may be beneficial in storing, shipping, and/or otherwise handling the sleeve 14. When the sleeve 14 is ready for final assembly with a corresponding tray 12, the sleeve 14 is opened by folding the sleeve 14 along the remaining fold lines 36 and 32 as illustrated in FIG. 5. Upon opening the sleeve 14, the locking tab 52 is self-initializing in that it is automatically deployed in a locking position wherein the locking portion 52A of the locking tab 52 is offset from the panel 46. In this example, the locking tab 52, the panel 46 and portions of the panels 40, 44 form a quadrilateral.

The relative offset position of the locking portion 52A from the panel 46 is dependent upon the offset d1 of the fold line 58 from the fold line 38, as well as the length of the locking portion 52A between the fold lines 58 and 60. In this example, the offset distance of the locking portion 52A from the panel 46 increases as the locking portion moves away from the panel 40 (d1) toward the panel 44 (d2) because the overall length of the locking portion 52A is slightly greater than the width of the panel 46. It will be understood, however, that the length of the locking portion 52A may be adjusted to adjust the offset distance from the panel 46 as desired.

Additionally, in this example, the locking portion 52A is defined as an uninterrupted panel without any fold lines, hinges, or any other lines of weakness. Thus, the maximum offset distance of the locking portion 52A from the panel 46 will be the offset distance d2. Accordingly, in the examples presented, the locking portion 52A will not extend beyond the maximum offset distance d2 under normal circumstances, i.e., when the sleeve 14 and/or the locking portion 52A are not under the influence of any forces manipulating the shape beyond the intended design.

Furthermore, in this example, the sleeve 14 when examined from the bottom elevational view presents a generally rectangular profile, which because of the flexibility of the example material may be manipulated into a trapezoidal profile having a slightly arced upper panel. It will be appreciated by one of ordinary skill in the art that the profile shape of the sleeve 14 may be varied as desired.

Finally, while the example sleeve 14 is illustrated with only one locking tab 52 formed on a single side of the sleeve 14, it will be understood that the sleeve 14 may include multiple locking tabs 52, either along one panel of the sleeve 14, or along multiple panels.

Figure 6:
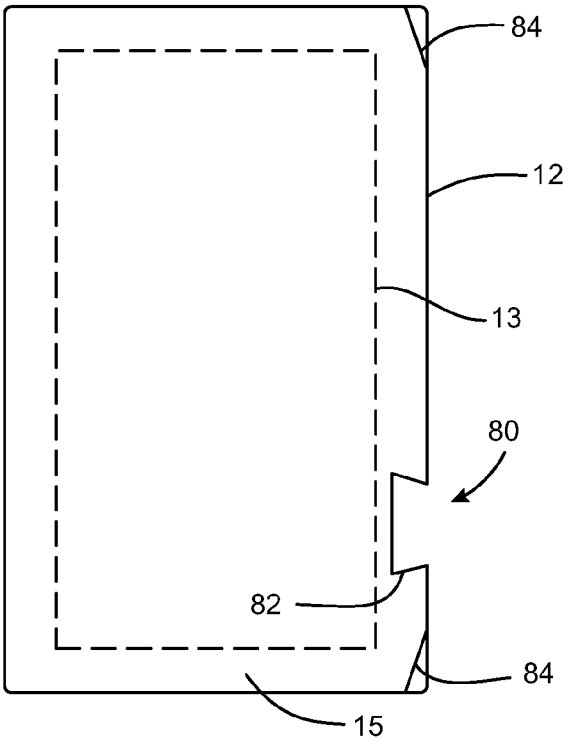
FIG. 6. is a top plan view of an example tray for use in combination with the example sleeve of FIG. 5.
Figure 7:
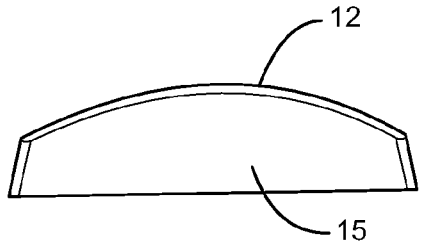
FIG. 7 is a bottom elevational view of the example tray of FIG. 6.

Referring to FIGS. 6 and 7, there is illustrated an example of the tray 12 for use in combination with the sleeve 14. In this example, the tray 12 is a three-dimensional tray for retaining merchandise and, as noted above, in at least one example, the tray 12 is thermoformed and/or otherwise molded to provide a custom cavity 13 (in this example, a rectangular shaped depression) to retain the merchandise item therein. The cavity 13 includes end walls 15 to close the open end of the sleeve 14 and to prevent removal of any item in the cavity 13 when the tray 12 is retained in the sleeve 14. In other examples, the cavity may be molded to retain other merchandise items, such as, for example, disposable razors, or any other item. In this example, the tray 12 includes an exterior surface end elevational profile corresponding to the interior profile of the sleeve 14. In order to better secure the tray 12 within the sleeve 14, in this example the general profile of the tray 12

(see FIG. 7) is within a relatively small tolerance of the interior profile of the sleeve 14, and has a profile larger than the profile of the sleeve 14 in combination with the locking tab 52.

The example tray 12 includes an indent, depression, channel, etc., such as a notch 80 formed in a portion of the tray 12 and located such that when properly inserted into the sleeve 14, the notch 80 will matingly engage with the locking tab 52. As seen in FIG. 6, the width of the example notch 80 substantially corresponds to the width of the locking tab 52. The notch 80 may also include at least one cammed surface 82 to bias and/or retain the locking tab 52 within the notch 80 when the locking tab 52 is seated within the notch 80 upon assembly. Still further, in at least one example, the leading edge of the tray 12 (e.g., the edge inserted into the sleeve 14 during assembly, see FIG. 1) and/or the trailing edge of the tray 12 may include a cammed surface 84 to assist in translating the locking tab 52 toward the panel 46 to allow the sleeve 14 to traverse the tray 12.

Referring again to FIG. 1, an example method of assembling the package 10 is illustrated. In this example, the opened sleeve 14 is ready to receive the tray 12, which has already been provided with the item to be packaged. Although not shown in FIG. 1, it will be appreciated that the locking tab 52 is deployed as illustrated in FIG. 5. In this example, the tray 12 approaches the sleeve 14 at an angle, such as for example, at approximately twenty-five degrees. In this manner, the leading edge of the tray 12 may contact the locking tab 52, and the tray 12 may be rotated to depress the locking tab towards the panel 46 and allow the tray 12 to slide into the sleeve 14. Alternatively, as noted above the leading edge of the tray 12 may be provided with a rounded, smooth, or otherwise cammed surface 84, and/or a reduced cross section to similarly allow the tray 12 to pass beyond the locking tab 52.

Figure 8:
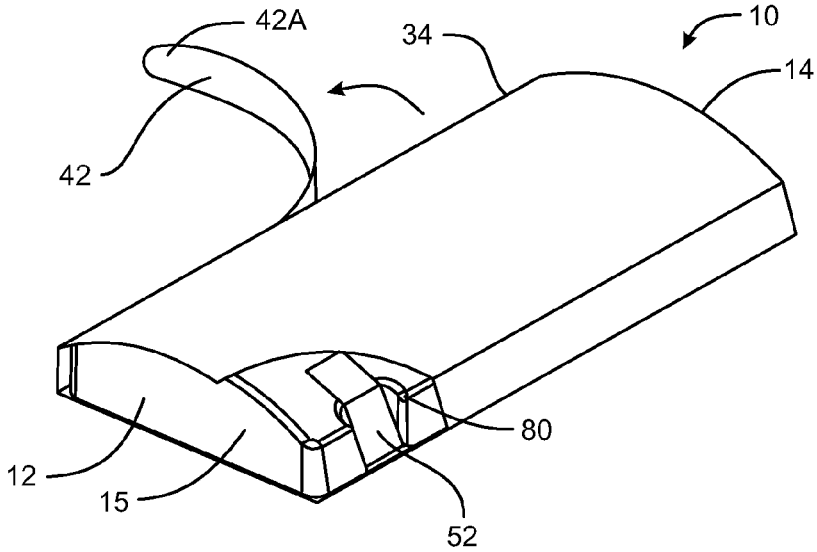
FIG. 8 is a top perspective view of the example assembled package of FIG. 1, showing a portion of the sleeve removed to expose the locking tab and notch.

Once sufficiently inserted into the sleeve 14, the locking tab 52 aligns with the notch 80, and the locking tab 52 is free to resiliently rebound into its non-depress state, thus seating the locking tab 52 into the notch 80 as is illustrated in FIG. 8. As shown in FIG. 8, the locking tab 52 is fully seated into the notch 80 such that relative movement of the tray 12 in the sleeve 14 is sufficiently prevented. In other words, in this example, the seating of the locking tab 52 within the notch 80 is sufficient so as to prevent sliding of the tray 12 out of the sleeve 14, thus securing the contents of the tray 12 within the sleeve 14 by preventing opening of the package 10 without destroying the package 10. Therefore, the package 10 provides a sufficient theft deterrent, by preventing covert removal of the contents of the package 10.

Because a legitimate consumer may wish to remove the tray 12 from the sleeve 14, without having to resort to manually ripping and/or otherwise destroying the package 10, one or more of the fold lines of the sleeve 14 may be perforated to allow a purchaser to easily open the package 10. As illustrated in the example of FIGS. 2A, 2B, and 8, the top of the panel 42 is provided with an arcuate portion 42*a*. The arcuate portion 42*a* forms a tab sufficient to allow a purchaser to grab and rip the panel 42 from the sleeve 14 along the perforated fold tabs 32 and 34. It will be appreciated that the sleeve 10 may be provided with an additional and/or alternative opening portions including apertures, removable labels, perforated sections, or any other suitable opening means. Thus, in this example, it will be understood that the package 10 is not intended for reuse and/or multiple open/close cycles, but it can be appreciated that by providing certain materials, such as an unlock tool or various non-deformable materials, the package 10 may be reused as desired.

Figure 9:
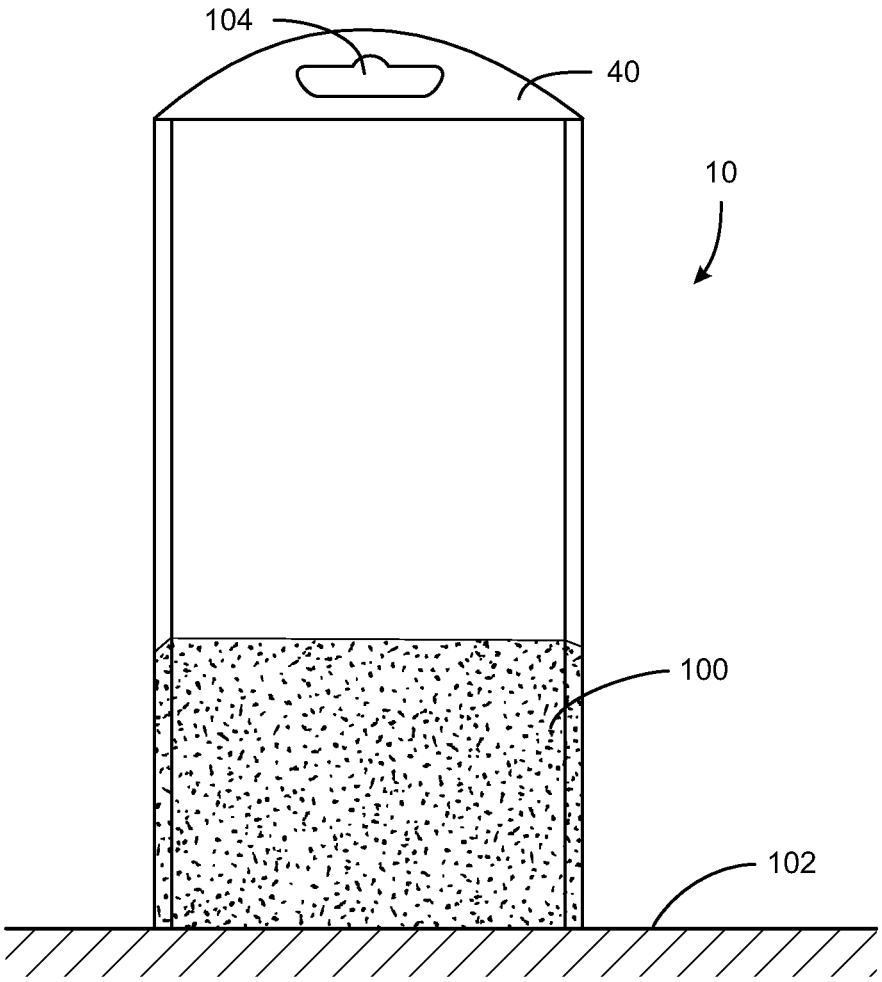
FIG. 9 is a front elevational view of the example assembled package of FIG. 1.

As shown in the example of FIG. 9, the disclosed package 10 may provide for at least one additional benefit. In particular, as noted above, the sleeve 14 may comprise a portion that is at least transparent to allow a person and/or machine to view the product disposed inside the tray 12. This visual reference may be for the benefit of inventory control, or may be for visual marketing purposes. Regardless of the transparency of the sleeve 14, the sleeve 14 may also be provided with at least one opaque area 100 such as mentioned above a printing, graphic, label, etc, to obscure the locking tab 52 from external view thus making the locking tab 52 difficult to detect and/or defeat.

Additionally, the cross section of the sleeve 14 ad the tray 12 may allow the package to be displayed standing on a support surface 102, thus obviating the need to hang the package.

Finally, as shown in FIGS. 1A, 1B, at least one of the panels, in this example, panel 40, may be provided with an additional and/or integrated appendage, portion, and/or accessory to provide a convenient way to display the assembled package 10. For instance, if it is desired to hang the package 10, at least one hanging aperture 104 may be provided on at the appendage to allow the package to be display by hanging.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A self-initialized lockable package assembly comprising:

a sleeve comprising:

a top panel, a bottom panel, a first side panel connecting the top panel and the bottom panel, and a second side panel connecting the top panel and the bottom panel, wherein together the top panel, the bottom panel, and the side panels form the sleeve having a substantially quadrilateral cross section with four inside corners, wherein a first inside corner of the quadrilateral is defined by the intersection of the top panel and a selected one of the first or second side panels and a second inside corner of the quadrilateral is defined by the intersection of the bottom panel and the selected one of the first or second side panels, and a self-initializing locking tab extending between the top panel and the bottom panel and being offset from each of the four inside corners and further being offset from the first inside corner and being offset from the second inside corner, wherein the offset distance from the first inside corner is at least the same distance as the offset from the second inside corner; and an insert at least partially slidably receivable within the opening of the sleeve, the insert comprising:

a receptacle for retaining an item, a perimeter defining the insert, and a notch formed in at least one portion of the perimeter of the insert, when the insert is properly inserted into the sleeve, the self-initializing locking tab seats within the notch to substantially prevent relative movement between the insert and the sleeve.

2. A package as defined in claim 1, wherein the self-initializing locking tab is resiliently depressible by the perimeter of the insert towards the selected one of the first or second side panels to allow the insert to slide relative to the sleeve.

3. A package as defined in claim 2, wherein the perimeter of the insert includes at least one cammed surface to depress the self-initializing locking tab toward the selected one of the first or second side panels.

4. A package as defined in claim 1, wherein the sleeve further comprises at least one additional panel such that, together, the panels of the sleeve have a polygonal cross section.

5. A package as defined in claim 1, wherein the self-initializing locking tab, the selected one of the first or second side panels, at least a portion of the top panel, and at least a portion of the bottom panel form a quadrilateral cross section.

6. A package as defined in claim 1, wherein the self-initializing locking tab is substantially a single plane.

7. A package as defined in claim 1, wherein the sleeve is at least partially opaque to obscure the self-initializing locking tab from view outside of the sleeve.

8. A package as defined in claim 1, wherein the notch further comprises at least one cammed surface to urge the self-initializing locking tab into the notch.

9. A package as defined in claim 1, wherein the sleeve further comprises at least one line of weakness to allow the sleeve to be separated, thus opening the package.

10. A package as defined in claim 9, wherein the line of weakness is a perforation.

11. A package as defined in claim 10, wherein the perforation is located along at least one corner defined as the intersection of two of the panels forming the sleeve.

12. A package as defined in claim 1, wherein the sleeve is collapsible prior to assembly such that an inner surface of the top panel rests upon an inner surface of the bottom panel in a substantially flat arrangement.

13. A package as defined in claim 12, wherein movement of the sleeve from the collapsed position toward a position for receiving the insert automatically extends the self-initializing locking tab into a locking position.

14. A sleeve for receiving an insert having a notch formed in the perimeter, the sleeve comprising:

a plurality of panels forming an opening having a polygonal cross section with a plurality of inside corners, wherein a first inside corner of the polygon is defined by the intersection of a top panel and a side panel and a second inside corner of the polygon is defined by the intersection of a third panel and the side panel; and a self-initializing locking tab extending between the top panel and the third panel and being offset from each of the plurality of inside corners and further being offset from the first inside corner and being offset from the second inside corner at least the same distance as the offset from the first corner, the self-initializing locking tab being resiliently moveable towards the side panel to allow passage of an insert slideably received within the opening of the sleeve, and the self-initializing locking tab being moveable away from the side panel to engage a depression formed in the insert and to prevent relative movement between the sleeve and the insert.

15. A sleeve as defined in claim 14, wherein the self-initializing locking tab, at least a portion of the top panel, the side panel, and at least a portion of the third panel form a quadrilateral cross section.

16. A sleeve as defined in claim 15, wherein the quadrilateral is a parallelogram.

17. A sleeve as defined in claim 14, wherein the self-initializing locking tab is substantially a single plane.

18. A sleeve as defined in claim 14, wherein the sleeve is at least partially opaque to obscure the self-initializing locking tab from view outside of the sleeve.

19. A sleeve as defined in claim 14, wherein the sleeve further comprises at least one line of weakness to allow the sleeve to be separated, thus allowing removal of the insert from the sleeve.

20. A sleeve as defined in claim 19, wherein the line of weakness is a perforation.

21. A sleeve as defined in claim 20, wherein the perforation is located along at least one corner defined as the intersection of two of the panels forming the sleeve.

22. A sleeve as defined in claim 14, wherein the sleeve is collapsible such that an inner surface of the top panel rests upon an inner surface of the third panel in a substantially flat configuration.

23. A sleeve as defined in claim 22, wherein movement of the sleeve from the collapsed position toward a position for receiving the insert automatically extends the self-initializing locking tab into the quadrilateral configuration.

24. A sleeve as defined in claim 23, further comprising an aperture for receiving a hook suitable to hang the sleeve.

25. A sleeve as defined in claim 24, wherein the aperture is at least one of integrally formed with at least one of the plurality of panels or externally attached to the at least one of the top, side, or third panels.

* * * * *